US008544192B2

(12) United States Patent
Hope et al.

(10) Patent No.: US 8,544,192 B2
(45) **Date of Patent: *Oct. 1, 2013**

(54) ARTICLE OF FOOTWEAR COMPRISING A PLURALITY OF STRIPS

(75) Inventors: Anthony Hope, Portland, OR (US); Kennon J. T. S. Konopasek, Busan (KR); Bryon Schroeder, Portland, OR (US)

(73) Assignee: Nike, Inc., Beaverton, OR (US)

( * ) Notice: Subject to any disclaimer, the term of this patent is extended or adjusted under 35 U.S.C. 154(b) by 101 days.

This patent is subject to a terminal disclaimer.

(21) Appl. No.: 13/243,416

(22) Filed: Sep. 23, 2011

(65) Prior Publication Data

US 2012/0011745 A1 Jan. 19, 2012

Related U.S. Application Data

(63) Continuation of application No. 12/266,361, filed on Nov. 6, 2008, now Pat. No. 8,051,585.

(51) Int. Cl.

| | |
|---|---|
| ***A43C 11/00*** | (2006.01) |
| ***A43B 23/00*** | (2006.01) |
| ***A43B 23/26*** | (2006.01) |

(52) U.S. Cl.
USPC ..... 36/50.1; 36/45; 36/54

(58) Field of Classification Search
USPC ..... 36/50.1, 45, 54, 3 A, 11.5; D2/916–918
See application file for complete search history.

(56) References Cited

U.S. PATENT DOCUMENTS

| | | | | |
|---|---|---|---|---|
| 1,540,903 | A | 6/1925 | Santoyo | |
| D87,016 | S * | 5/1932 | Meyer | D2/918 |
| 2,045,736 | A | 6/1936 | Turner | |
| 2,069,381 | A | 2/1937 | Morgan | |
| 2,161,472 | A | 6/1939 | Hurwit | |
| 2,240,626 | A | 5/1941 | Ochs | |
| 2,311,959 | A * | 2/1943 | Nurk | 36/3 A |
| 2,434,024 | A | 1/1948 | Vlasak | |
| 2,468,573 | A | 6/1949 | Rimer | |
| 2,537,602 | A | 1/1951 | Potvin | |
| D163,359 | S * | 5/1951 | Braun | D2/916 |
| 3,568,338 | A | 3/1971 | Nadler | |
| D253,139 | S | 10/1979 | Foldes | |
| 4,224,747 | A | 9/1980 | Winfield | |
| 4,481,725 | A | 11/1984 | Bergmans | |

(Continued)

FOREIGN PATENT DOCUMENTS

DE 1207238 12/1965

OTHER PUBLICATIONS

Invitation to Pay Additional Fees mailed Apr. 12, 2010, with Annex containing results of International Search from PCT Application No. PCT/US2009/063353.

(Continued)

*Primary Examiner* — Ted Kavanaugh
(74) *Attorney, Agent, or Firm* — Plumsea Law Group, LLC

(57) ABSTRACT

An article of footwear comprising a plurality of strips is disclosed. The connections between continuous portions of the article can be strengthened by weaving a plurality of strips through apertures disposed in one or more continuous portions. One continuous portion may include a tongue portion of an article. The attachment of the tongue portion to a front of an article may be strengthened by weaving a plurality of strips through apertures.

20 Claims, 7 Drawing Sheets

(56) References Cited

U.S. PATENT DOCUMENTS

| | | | | |
|---|---|---|---|---|
| D279,326 | S | 6/1985 | Foldes | |
| D293,964 | S | 2/1988 | Baungratz | |
| D300,781 | S | 4/1989 | Finn | |
| 5,177,882 | A | 1/1993 | Berger | |
| 5,271,130 | A | 12/1993 | Batra | |
| 6,128,834 | A | 10/2000 | Vecchiola et al. | |
| 6,128,835 | A | 10/2000 | Ritter et al. | |
| 6,505,424 | B2 | 1/2003 | Oorei et al. | |
| 7,204,042 | B2 * | 4/2007 | Aveni | 36/50.1 |
| D553,339 | S | 10/2007 | Fogg | |
| 7,293,371 | B2 | 11/2007 | Aveni | |
| D561,455 | S * | 2/2008 | Belley et al. | D2/969 |
| 8,037,621 | B2 * | 10/2011 | Hooper | 36/3 A |
| 8,051,585 | B2 * | 11/2011 | Hope et al. | 36/50.1 |
| 2006/0283042 | A1 | 12/2006 | Greene et al. | |
| 2008/0148600 | A1 | 6/2008 | Aveni et al. | |
| 2010/0107442 | A1 | 5/2010 | Hope et al. | |
| 2011/0302804 | A1 * | 12/2011 | Hooper | 36/31 |

OTHER PUBLICATIONS

Notification of Transmittal of The International Search Report and The Written Opinion of The International Searching Authority, or the Declaration mailed Sep. 27, 2010 in PCT Application No. PCT/US2009/063353.

International Preliminary Report on Patentability (including Written Opinion of the ISA) mailed May 19, 2011 in International Application No. PCT/US2009/063353.

* cited by examiner

ARTICLE OF FOOTWEAR COMPRISING A PLURALITY OF STRIPS

CROSS-REFERENCE TO RELATED APPLICATION

This application is a continuation of U.S. Pat. No. 8,051,585, currently U.S. application Ser. No. 12/266,361, entitled "Article of Footwear Comprising a Plurality of Strips", filed on Nov. 6, 2008, and issued on Nov. 8, 2011, which application is hereby incorporated by reference in its entirety.

BACKGROUND

The present invention relates to an article of footwear, and in particular to an article of footwear comprising a plurality of strips.

Articles comprising straps have been previously proposed. Oorei (U.S. Pat. No. 6,505,424) teaches an athletic shoe structure. In particular, Oorei teaches a shoe with band-shaped members. The band-shaped members are configured to effectively fasten and tighten a foot. Each band includes a loop-shaped turning portion. One of the band shaped members is folded back at the instep portion and the distal end of the band-shaped member is fixed to the rear end portion of the heel portion.

Vecchiola et al. (U.S. Pat. No. 6,128,834) teaches a shoe using a moulded bottom provided with a series of slots for the application of a strap-type closed upper. A long strap is provided through slots in the moulded bottom. Also, Hurwit (U.S. Pat. No. 2,161,472) teaches a woven shoe. The woven shoe includes an upper with slits configured to receive several strips. The strips turn at loops in the upper.

The related art lack provisions for reinforcing the upper, especially in the direction between the bottom and top of the upper. There is a need in the art for a design that overcomes these shortcomings.

SUMMARY OF THE INVENTION

The invention discloses an article of footwear comprising a plurality of strips. In one aspect, the invention provides an article of footwear, comprising: a first continuous portion including a base portion and a plurality of strips; a second continuous portion extending around an upper periphery of the article, the second continuous portion including a plurality of lacing holes for receiving a lace; at least one strip of the plurality of strips comprising a first end portion, a second end portion and an intermediate portion disposed between the first end portion and the second end portion; and where the first end portion is continuous with an outer periphery of the base portion and where the second end portion is attached to the base portion; and where the intermediate portion is disposed through an aperture in the second continuous portion.

In another aspect, the second end portion is attached to the outer periphery of the base portion.

In another aspect, the base portion includes a central portion disposed inwards of the outer periphery and wherein the second end portion is attached to the central portion.

In another aspect, the first continuous portion is attached to a third continuous portion that extends throughout a lacing system of the article of footwear.

In another aspect, the third continuous portion includes a first end portion that is configured to receive at least one strip of the first continuous portion to facilitate attachment of the third continuous portion to the article of footwear.

In another aspect, the at least one strip forms a loop.

In another aspect, the invention provides an article of footwear, comprising: a first continuous portion including a base portion and a plurality of strips; a second continuous portion extending around an upper periphery of the article, the second continuous portion being configured to receive some of the plurality of strips; a third continuous portion including a first end portion and a second end portion; and where the first end portion includes at least one aperture configured to receive at least one of the plurality of strips and wherein the second end portion extends through a lacing system of the article.

In another aspect, the first end portion includes a plurality of apertures configured to receive two or more strips.

In another aspect, the two or more strips are woven through the plurality of apertures in an alternating manner to form a plain weaving pattern.

In another aspect, the first end portion includes one or more extended portions that are configured to attach to a toe portion of the first continuous portion.

In another aspect, the third continuous portion forms a tongue of the article.

In another aspect, the second end portion can be used to adjust the lacing system.

In another aspect, the first continuous portion comprises a substantial majority of the article.

In another aspect, the invention provides an article of footwear, comprising: a first continuous portion including a base portion and a plurality of strips; a second continuous portion extending around an upper periphery of the article, the second continuous portion including a plurality of lacing holes for receiving a lace; at least one strip of the plurality of strips comprising a first surface and a second surface disposed opposite of the first surface; at least one strip extending through an aperture in the second continuous portion; and where a portion of the first surface and a portion of the second surface are exposed on an outer portion of the article of footwear.

In another aspect, at least one strip comprises a first end portion and a second end portion and wherein the first end portion is disposed adjacent to the second end portion in a direction running along a length of the article.

In another aspect, the first continuous portion covers a substantial majority of the outer portion.

In another aspect, the first end portion is continuous with an outer periphery of the base portion and wherein the second end portion is fixedly attached to the base portion.

In another aspect, the length of at least one strip remains substantially fixed.

In another aspect, the first continuous portion and the second continuous portion comprise substantially similar materials.

In another aspect, the first continuous portion and the third continuous portion comprise substantially similar materials.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

DETAILED DESCRIPTION

Figure 1:
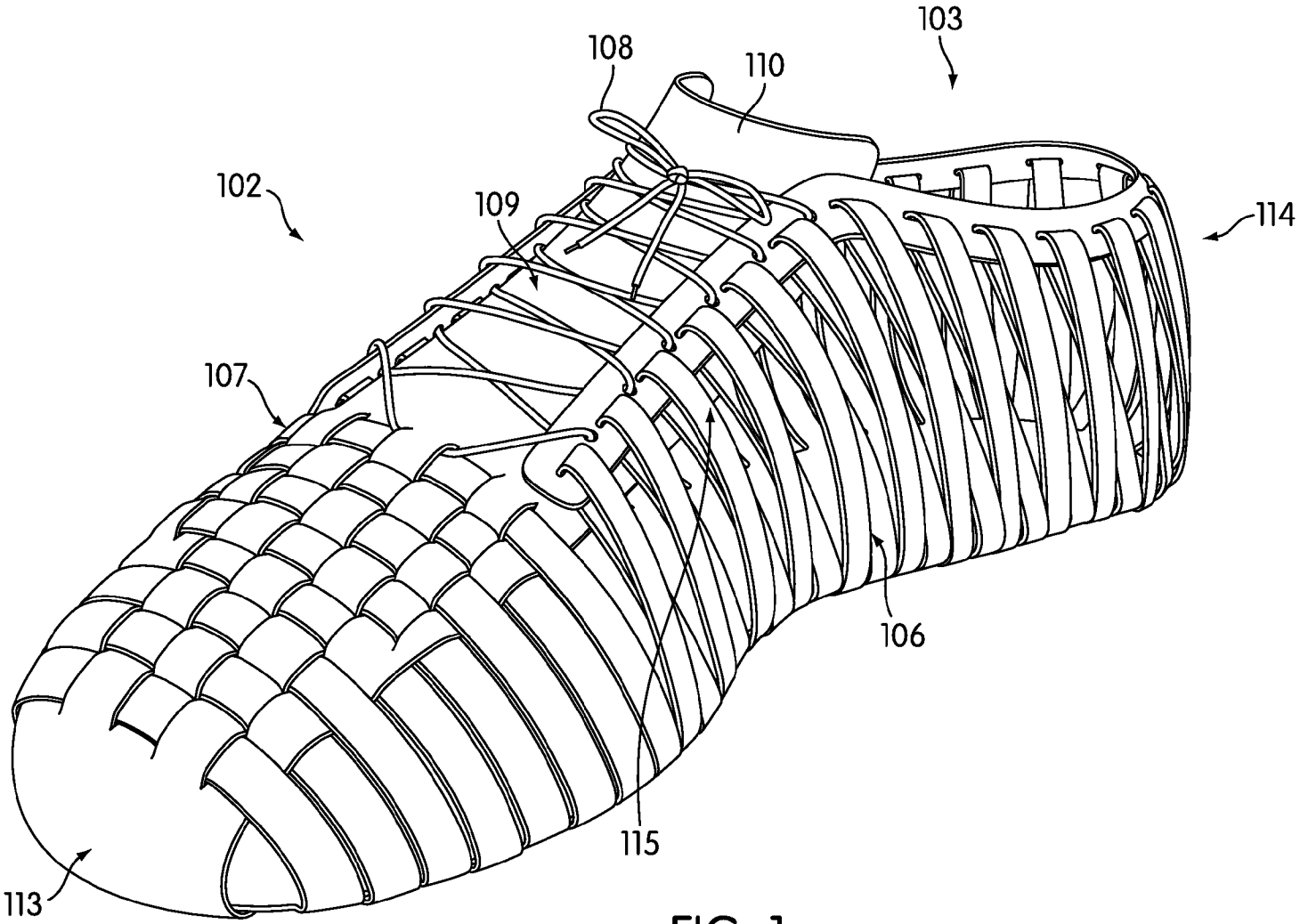
FIG. 1 is an isometric view of an exemplary embodiment of a medial portion of an article of footwear.
Figure 2:
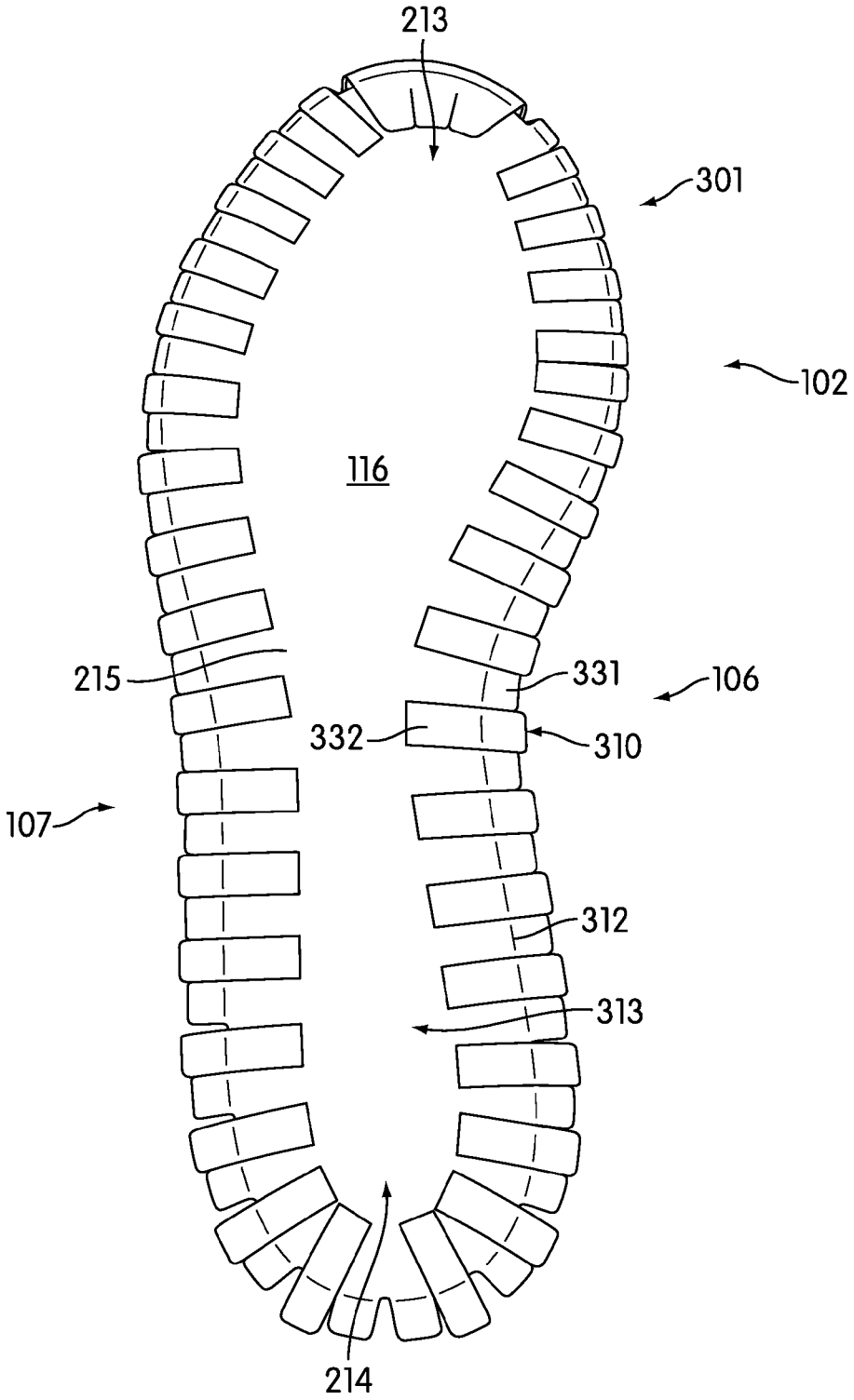
FIG. 2 is a bottom plan view of an exemplary embodiment of an article of footwear.

FIGS. 1 and 2 illustrate an exemplary embodiment of article of footwear 102. In particular, FIG. 1 is an isometric view of an exemplary embodiment of a medial portion of article of footwear 102 and FIG. 2 is a bottom view of an exemplary embodiment of article of footwear 102. Article of footwear 102 may be any type of article of footwear including, but not limited to: athletic shoes, sandals, cycling shoes, dance shoes, slippers, or any other kinds of footwear. As shown in FIGS. 1 and 2, article of footwear 102, also referred to as article 102, is intended to be used with a right foot; however, it should be understood that the following discussion may equally apply to a mirror image of article 102 that is intended for use with a left foot.

Generally, article 102 may comprise any type of upper. In particular, article 102 may comprise an upper with any design, shape, size and/or color. For example, in embodiments where article 102 is a basketball shoe, article 102 could comprise a high top upper that is shaped to provide high support on an ankle. In embodiments where article 102 is a running shoe, article 102 could comprise a low top upper.

Article 102 is configured to receive a foot of a wearer. In some embodiments, article 102 includes throat 103 configured to receive a foot of a wearer. Typically, throat 103 allows a foot to be inserted into an interior portion of article 102.

Article 102 may include medial portion 106. Also, article 102 may include lateral portion 107 disposed opposite medial portion 106. Furthermore, medial portion 106 may be associated with an inside of a foot. Similarly, lateral portion 107 may be associated with an outside of a foot.

Article 102 may also include toe portion 113 that is associated with the toes of a foot. In addition, article 102 may include heel portion 114 that is associated with a heel of a foot. Article 102 may also include middle portion 115 that is disposed between toe portion 113 and heel portion 114. With this arrangement, middle portion 115 may be associated with a midfoot, including an arch of a foot and a top of a foot.

Referring to FIG. 2, article 102 may also comprise base portion 116. Generally, base portion 116 may be shaped in a substantially similar manner as a bottom of a foot. In particular, base portion 116 includes toe portion 213 that may be associated with toes of a foot. Likewise, base portion 116 includes heel portion 214 that can be associated with a bottom heel of a foot. In addition, base portion 116 includes middle portion 215 disposed between toe portion 213 and heel portion 214. Middle portion 215 may be associated with a midfoot, including an arch of a foot.

In some embodiments, base portion 116 may be associated with a sole system including, but not limited to: an insole, midsole and/or outsole. For example, in some cases, an outsole may be attached to base portion 116 to form an article of footwear. This arrangement can allow article of footwear 102 to be configured as an upper for an article of footwear. However, in other embodiments, base portion 116 of article 102 may comprise a sole for an article of footwear.

In some embodiments, article 102 may include a fastening system configured to tighten article 102. Generally, article 102 could be associated with any type of fastening system including, but not limited to: laces, straps, zippers, hook and loop fasteners, as well as other types of fastening systems. In one exemplary embodiment, article 102 includes a fastening system with a lace.

Referring to FIG. 1, article 102 includes lacing system 109. Generally, lacing system 109 may be disposed on any portion of article 102. In some embodiments, lacing system 109 may be disposed between medial portion 106 and lateral portion 107 of article 102. In other embodiments, lacing system 109 may be disposed asymmetrically so that a portion of lacing system 109 is disposed entirely within medial portion 106 or lateral portion 107. In an exemplary embodiment, lacing system 109 may be disposed in a substantially symmetric manner on middle portion 115.

In some embodiments, lacing system 109 includes lace 108 to secure a foot within article 102. Generally, lace 108 may be configured with any length necessary to fasten article 102. In addition, lace 108 may be configured in a particular shape visible in a cross section of lace 108. In some cases, lace 108 may include a substantially flat cross section. In other cases, lace 108 may be configured with a substantially rounded cross section.

In embodiments where an article includes a lacing system, an article may include provisions to reduce friction when tightening the article around a foot. In one embodiment, article 102 includes tongue portion 110 to protect a foot from friction caused by lacing system 109. In particular, tongue portion 110 may be disposed below lace 108. With this arrangement, tongue portion 110 can protect a foot from potential friction caused by fastening lace 108.

In order to reduce waste generated during the construction of an article, an article may be constructed with a minimal number of components. By decreasing the number of pieces of material comprising the article, the amount of adhesive and waste involved in constructing the article may be reduced. In some embodiments, an article may be constructed using a single continuous portion. In other embodiments, an article may be constructed using two or more continuous portions. In an exemplary embodiment, an article may comprise three continuous portions.

Figure 3:
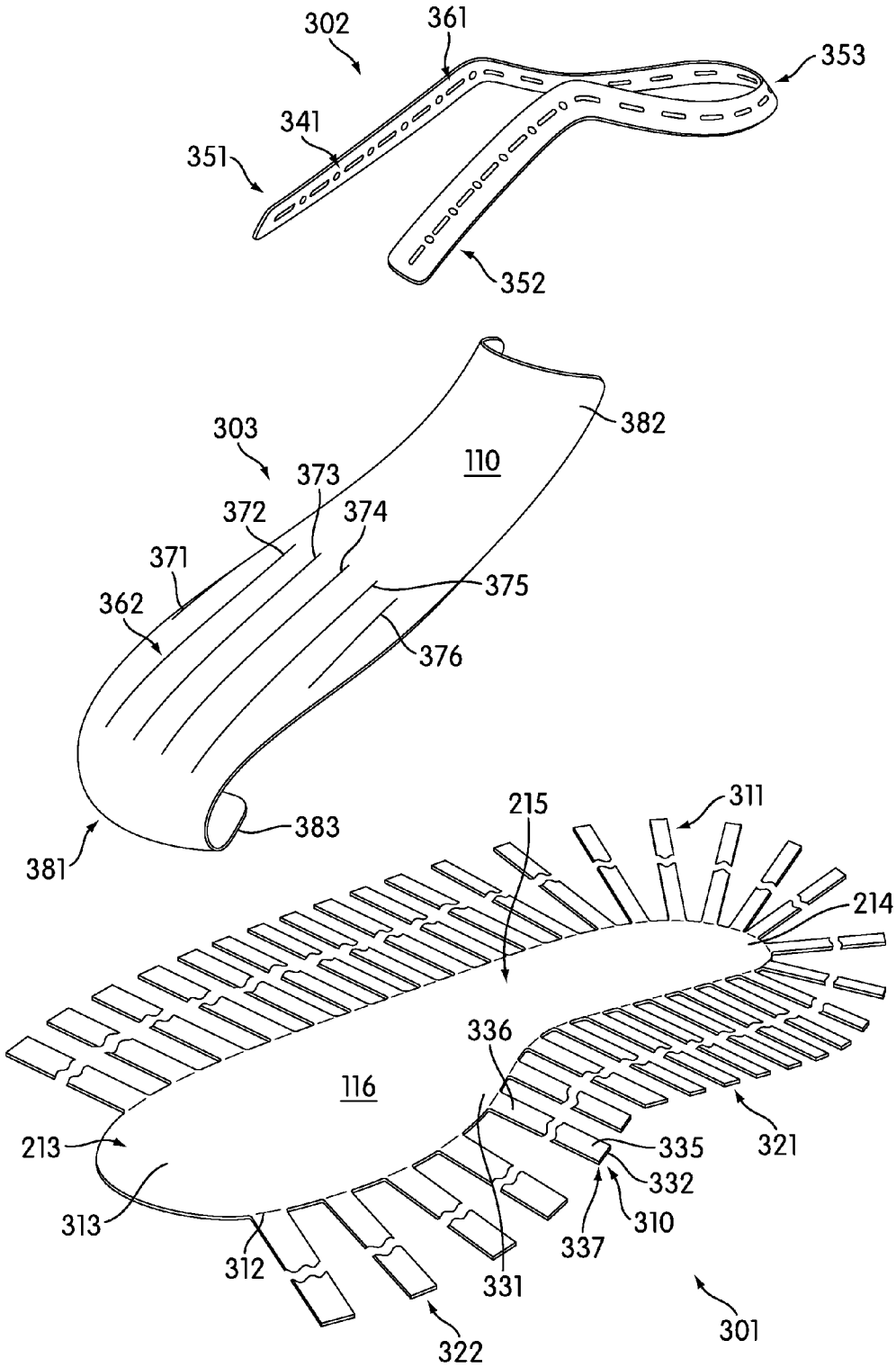
FIG. 3 is an exploded isometric view of an exemplary embodiment of an article of footwear.

FIG. 3 is an exploded isometric view of an exemplary embodiment of article 102. In one embodiment, article 102 comprises three continuous portions. In particular, article 102 may include first continuous portion 301, second continuous portion 302 and third continuous portion 303.

In some embodiments, first continuous portion 301 may comprise the majority of article 102. In particular, first continuous portion 301 may include base portion 116 of article 102. Additionally, first continuous portion 301 may include plurality of strips 311 that extend from base portion 116. In some cases, plurality of strips 311 may be integrally formed with base portion 116.

Generally, plurality of strips 311 may extend from any portion of base portion 116. In some embodiments, plurality of strips 311 may extend from outer periphery 312 of base portion 116. In other embodiments, plurality of strips 311 may extend from central portion 313 of base portion 116 disposed inward of outer periphery 312.

In one embodiment, plurality of strips 311 includes first strip set 321 and second strip set 322. First strip set 321 extends from outer periphery 312 of middle portion 215 and heel portion 214 of base portion 116. In a similar manner, second strip set 322 extends from outer periphery 312 of toe portion 213. With this arrangement, first strip set 321 and second strip set 322 are disposed over a substantial portion of outer periphery 312.

Generally, plurality of strips 311 may include any number of strips. In one embodiment, plurality of strips 311 may include approximately 34 strips. However, in other embodiments, plurality of strips 311 may include more or less than 34 strips.

In different embodiments, the shapes and sizes of strips of plurality of strips 311 may vary. Generally, strips of plurality of strips 311 may be formed into various shapes including, but not limited to: square shapes, rectangular shapes, elliptical shapes, triangular shapes, regular shapes, irregular shapes as well as other types of shapes. In some embodiments, plurality of strips 311 may include strips with varying shapes. For example, first strip set 321 may comprise strips of a first shape. Likewise, second strip set 322 may comprise strips of a second shape that is different from the first shape. In other cases, first strip set 321 and second strip set 322 may include strips with varying shapes. In other embodiments, plurality of strips 311 may include strips with substantially similar shapes.

In one embodiment, each of the strips of first strip set 321 and second strip set 322 are formed with a substantially similar shape. In particular, first strip set 321 and second strip set 322 include strips with approximately elongated rectangular shapes. In addition, strips of first strip set 321 and second strip set 322 are substantially two-dimensional. In other words, strips of first strip set 321 and second strip set 322 may be associated with a thickness that is less than a length and width of a strip.

For purposes of clarity, the following discussion describes a single strip of plurality of strips 311. It should be understood that the remaining strips of plurality of strips 311 may be configured in a substantially similar manner. In particular, first strip 310 of plurality of strips 311 may be associated with first strip set 321. However, strips of second strip set 322 may be configured in a substantially similar manner.

First strip 310 of plurality of strips 311 includes first end portion 331 that is integrally formed with outer periphery 312 of base portion 116. First strip 310 also includes second end portion 332 disposed opposite first end portion 331. Furthermore, first strip 310 includes intermediate portion 335 disposed between first end portion 331 and second end portion 332.

As previously discussed, strips of first strip set 321 and second strip set 322 may be substantially two-dimensional. In other words, strips may be associated with a first surface and a second surface. For example, first strip 310 includes first surface 336 and second surface 337 disposed opposite first surface 336.

Article 102 may also include second continuous portion 302. In some embodiments, second continuous portion 302 may be associated with throat 103 and lacing system 109 of article 102, as illustrated in FIG. 1. With this arrangement, second continuous portion 302 may extend around an upper periphery of article 102.

In different embodiments, the shape and size of second continuous portion 302 may vary. Generally, second continuous portion 302 may be associated with various shapes. Examples of different shapes include, but are not limited to: square shapes, rectangular shapes, elliptical shapes, triangular shapes, regular shapes, irregular shapes as well as other types of shapes. In one embodiment, second continuous portion 302 is configured in a rectangular strap-like shape. In other words, second continuous portion 302 is configured with a length that is greater than a width and a thickness of second continuous portion 302.

In an exemplary embodiment, second continuous portion 302 includes first portion 351. In addition, second continuous portion 302 may include second portion 352, disposed opposite first portion 351. Also, second continuous portion 302 includes intermediate portion 353 disposed between first portion 351 and second portion 352.

In embodiments where article 102 is associated with a lacing system, second continuous portion 302 can include provisions for receiving a lace to help maintain article 102 in a tightened position during use. In some embodiments, second continuous portion 302 may include a plurality of lacing holes 341 for receiving lace 108, as illustrated in FIG. 1. In different embodiments, plurality of lacing holes 341, also referred to as lacing holes 341, may be configured with varying sizes and shapes in order to receive lace 108. With this arrangement, lacing holes 341 of second continuous portion 302 may receive lace 108 in order to tighten article 102 around a foot.

Generally, lacing holes 341 may be disposed on any portion of second continuous portion 302. In some embodiments, lacing holes 341 may be disposed on first portion 351. In other embodiments, lacing holes 341 may be disposed on second portion 352. In an exemplary embodiment, lacing holes 341 may be disposed on both first portion 351 and second portion 352.

In some embodiments, second continuous portion 302 may be configured to receive some of a plurality of strips. In one embodiment, second continuous portion 302 may include first set of apertures 361 to receive strips of plurality of strips 311. In some cases, first set of apertures 361 may comprise holes that extend through the thickness of second continuous portion 302.

Generally, first set of apertures 361 may be disposed on any portion of second continuous portion 302. In some cases, first set of apertures 361 may be disposed on intermediate portion 353. In an exemplary embodiment, first set of apertures 361 may be disposed on a substantial majority of second continuous portion 302. In particular, first set of apertures 361 may be approximately evenly spaced through first portion 351, second portion 352 and intermediate portion 353 of second continuous portion 302.

In some embodiments, first set of apertures 361 may be configured to receive strips of a continuous portion of article 102. In one embodiment, first set of apertures 361 may be configured to receive strips of plurality of strips 311 of first continuous portion 301. In other words, apertures of first set of apertures 361 may be configured with a size and shape configured to receive strips of plurality of strips 311. In some cases, apertures of first set of apertures 361 may be configured with a shape and size to receive more than one strip of plurality of strips 311. In other cases, apertures of first set of apertures 361 may be configured with a shape and size to receive one strip of plurality of strips 311.

In different embodiments, first set of apertures 361 may include varying numbers of apertures. For example, in some embodiments, first set of apertures 361 may include a number of apertures so that each aperture may receive at least one strip of plurality of strips 311. In other cases, first set of apertures 361 may include a number of apertures to receive more than one strip of plurality of strips 311. In one embodiment, first set of apertures 361 may include a number of apertures so that each aperture may receive a strip of first strip set 321 of plurality of strips 311. With this arrangement, second continuous portion 302 may be associated with first continuous portion 301. Details of the association between second continuous portion 302 and first continuous portion 301 will be discussed in more detail later in this detailed description.

Article 102 may also comprise third continuous portion 303. In some embodiments, third continuous portion 303 may include tongue portion 110. As previously discussed, tongue portion 110 may be associated with lacing system 109, as illustrated in FIG. 1. In some cases, tongue portion 110 may protect a top of a foot from potential friction with lacing system 109.

In different embodiments, the shape and size of third continuous portion 303 may vary. Generally, third continuous portion 303 may be associated with various shapes. Examples of different shapes include, but are not limited to: square shapes, rectangular shapes, elliptical shapes, triangular shapes, regular shapes, irregular shapes as well as other types of shapes.

In one embodiment, third continuous portion 303 may comprise a contoured rectangular shape. In particular, third continuous portion 303 may include first end portion 381 and second end portion 382, disposed opposite first end portion 381. First end portion 381 may be associated with toes of a foot inserted within article 102. Similarly, second end portion 382 may extend throughout lacing system 109, as illustrated in FIG. 1.

In some embodiments, first end portion 381 may include one or more extended portions that are configured to attach to a portion of first continuous portion 301. In an exemplary embodiment, first end portion 381 includes extended portion 383. Generally, extended portion 383 can be configured with any shape including, but not limited to: square shapes, rectangular shapes, elliptical shapes, triangular shapes, regular shapes, irregular shapes as well as other types of shapes. In one embodiment, extended portion 383 is configured with a shape substantially similar to the shape of toe portion 213 of first continuous portion 301.

In some embodiments, third continuous portion 303 may include provisions to receive strips. In one embodiment, third continuous portion 303 may include second set of apertures 362 to receive strips. In some cases, second set of apertures 362 provide holes that extend through the thickness of third continuous portion 303.

Generally, second set of apertures 362 may be disposed on any portion of third continuous portion 303. In some embodiments, second set of apertures 362 may be disposed on an entirety of third continuous portion 303. In other embodiments, second set of apertures 362 may be disposed on a portion of third continuous portion 303. In some cases, second set of apertures 362 may be disposed on second end portion 382. In one embodiment, second set of apertures 362 may be disposed on first end portion 381 of third continuous portion 303.

In some embodiments, second set of apertures 362 may be configured to receive strips of plurality of strips 311 of first continuous portion 301. In other words, apertures of second set of apertures 362 may be configured with a size and shape configured to receive strips of plurality of strips 311. In some cases, apertures of second set of apertures 362 may be configured with a shape and size to receive at least one strip of plurality of strips 311. In an exemplary embodiment, apertures of second set of apertures 362 may be configured with a shape and size to receive more than one strip of plurality of strips 311. This arrangement allows more than one strip to be inserted through each aperture of second set of apertures 362.

In different embodiments, second set of apertures 362 may include varying numbers of apertures. For example, in some embodiments, second set of apertures 362 may include at least one aperture configured to receive at least one of plurality of strips 311. In some cases, second set of apertures 362 may include six or more apertures. In other cases, second set of apertures 362 may include less than six apertures. In an exemplary embodiment, second set of apertures 362 may include six apertures. In particular, second set of apertures 362 includes first aperture 371, second aperture 372, third aperture 373, fourth aperture 374, fifth aperture 375 and sixth aperture 376.

In some cases, second set of apertures 362 may be associated with all strips of plurality of strips 311. In other cases, second set of apertures 362 may be associated with a subset of strips of plurality of strips 311. In one embodiment, second set of apertures 362 may be configured to receive second strip set 322 of plurality of strips 311. With this configuration, third continuous portion 303 may be associated with first continuous portion 301. Details of this association between first continuous portion 301 and third continuous portion 303 will be described in greater detail later in this detailed description.

Generally, first continuous portion 301, second continuous portion 302 and third continuous portion 303 may be constructed from any suitable material. Examples of material include but are not limited to: nylon, natural leather, synthetic leather, natural rubber, other synthetic rubbers, elastomers, siloxanes, aluminum, steel or plastics. In some embodiments, components of article 102 may be made of a substantially stiff or rigid material in order to facilitate support to a foot. For example, in some cases, base portion 116 of first continuous portion 301 may be made of a substantially stiff or rigid material in order to form a sole for an article of footwear. By selecting different types of materials for components of article 102, the degree of stiffness and flexibility of article 102 can be fine-tuned to accommodate the needs of a particular article of footwear.

Generally, lace 108 may comprise any material including, but not limited to: leather, cotton, jute, hemp, or synthetic fibers. Additionally, lace 108 may be coated with a material to increase friction in order to keep lace 108 fastened. In some cases, lace 108 may include elastic portions. Also, in some cases, one or more ends of lace 108 may be configured with aglets to make threading lace 108 easier.

Figure 4:
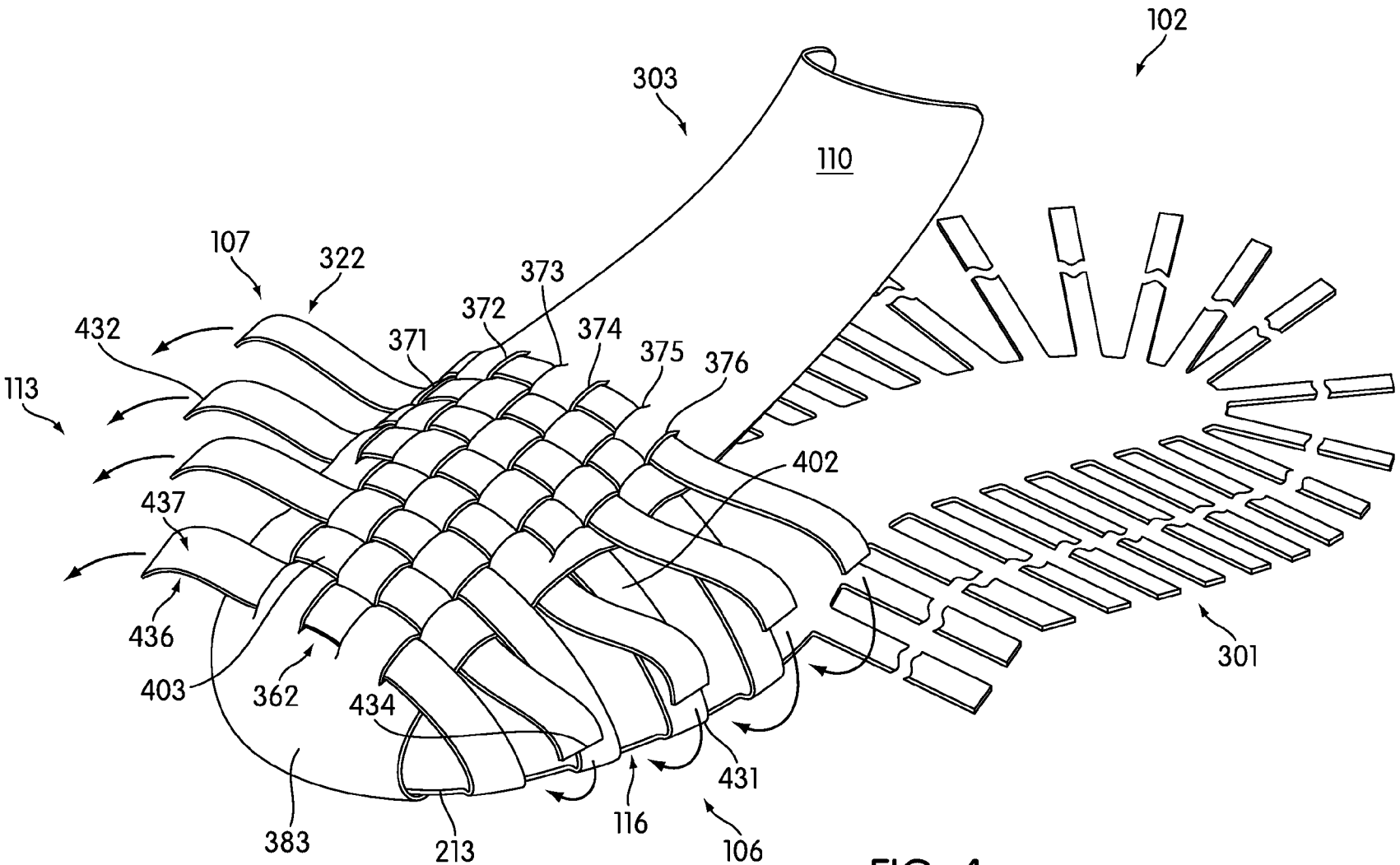
FIG. 4 is an isometric view of an exemplary embodiment of a connection between a first continuous portion and a third continuous portion of an article of footwear.
Figure 5:
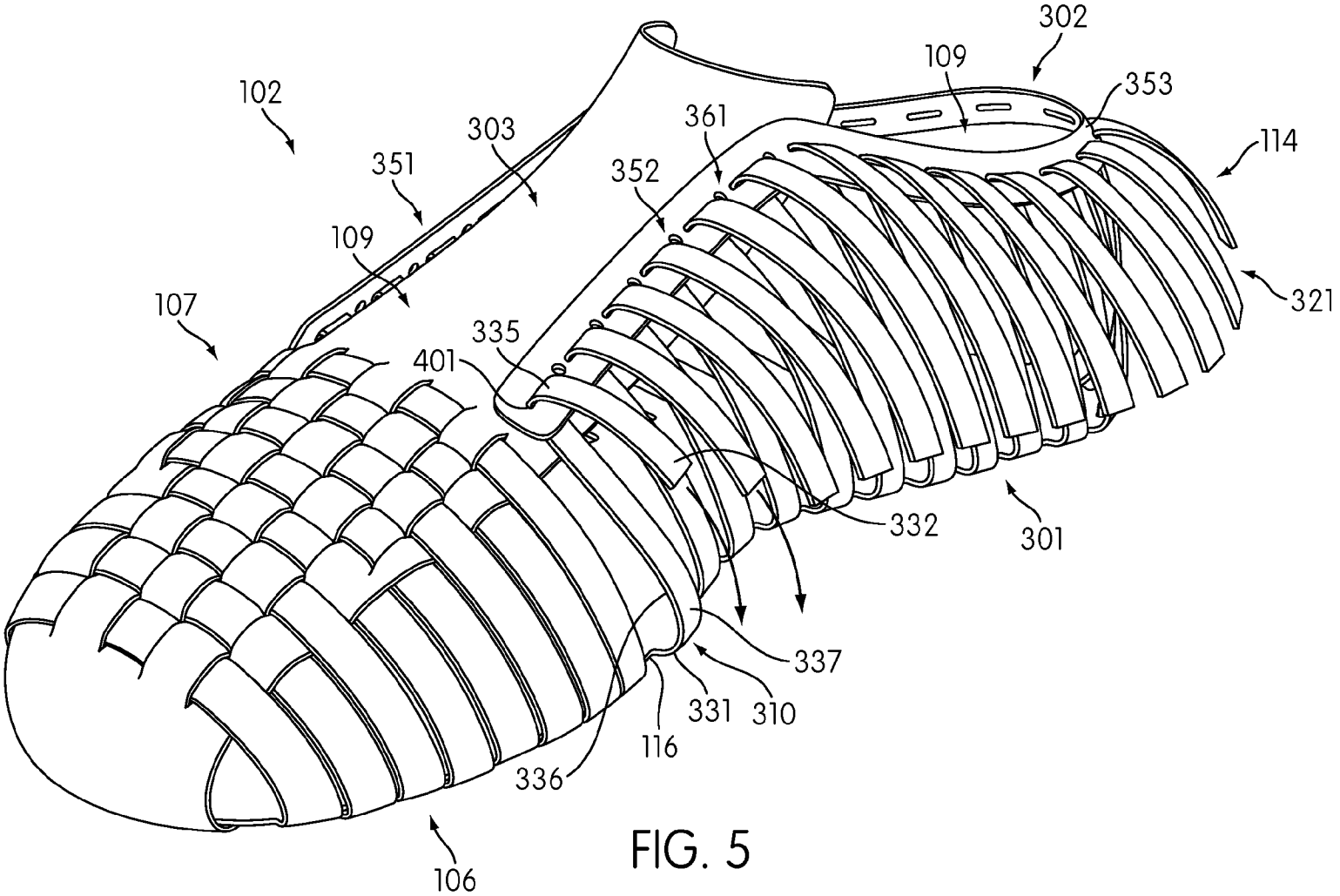
FIG. 5 is an isometric view of an exemplary embodiment of a connection between a first continuous portion and a second continuous portion of an article of footwear.
Figure 6:
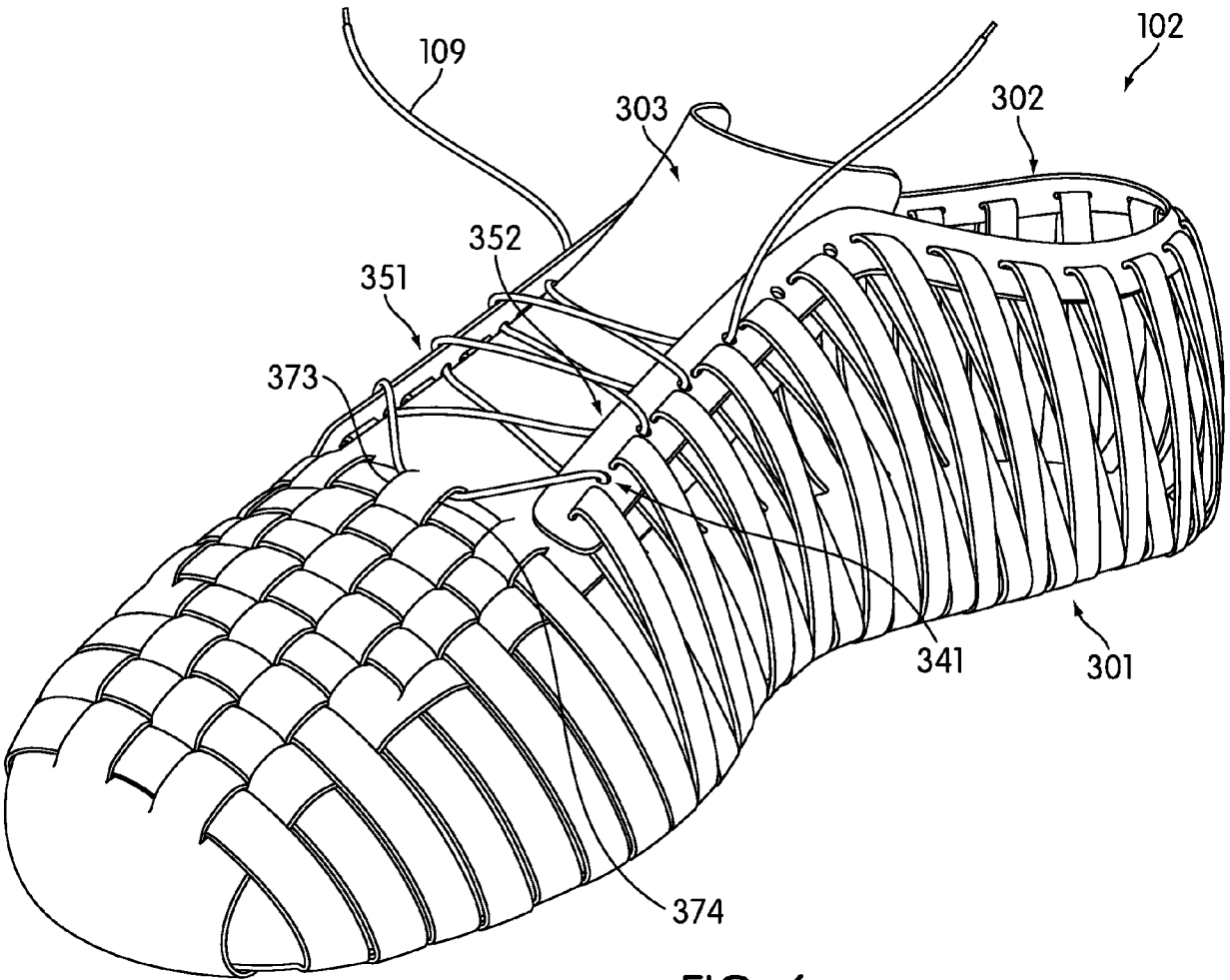
FIG. 6 is an isometric view of an exemplary embodiment of an insertion of a lace into an article of footwear.

FIGS. 4-6 illustrate schematic views of an exemplary embodiment of an assembly of first continuous portion 301, second continuous portion 302 and third continuous portion 303 to form article 102. Generally, article 102 may be formed from first continuous portion 301, second continuous portion 302 and third continuous portion 303 in any manner known in the art. It should be understood that the steps illustrated in FIGS. 4-6 are intended to illustrate an exemplary embodiment of an assembly of article 102 from first continuous portion 301, second continuous portion 302 and third continuous portion 303. In other embodiments, the steps of assembling article 102 from first continuous portion 301, second continuous portion 302 and third continuous portion 303 may be executed in a different order or in a different manner. For example, in some cases, portions of first continuous portion 301, second continuous portion 302 and third continuous portion 303 may be glued, sewn or otherwise attached to each other.

An article comprising a few continuous portions can include provisions for strengthening the connection between two or more of the continuous portions. In some embodiments, continuous portions can be glued, sewn, laced or otherwise attached to each other. In embodiments where continuous portions include strips, the strips can be woven through continuous portions of the article to strengthen the connection between one or more continuous portions.

FIG. 4 illustrates an exemplary embodiment of first continuous portion 301 connecting to third continuous portion 303. In some embodiments, an extended portion of third continuous portion 303 may be attached to a portion of first continuous portion 301. In one embodiment, extended portion 383 of third continuous portion 303 may be attached to toe portion 213 of first continuous portion 301. This can be accomplished through any manner known in the art, including, but not limited to: adhesives, stitching as well as other methods. By attaching extended portion 383 to toe portion 213 of first continuous portion 301, tongue portion 110 of third continuous portion 303 is attached to first continuous portion 301. With this arrangement, tongue portion 110 may be connected to a forward portion of article 102.

An article may include provisions for strengthening the attachment of a tongue portion to a front of an article. In some embodiments, an article may include a plurality of strips that may be woven though the tongue portion in order to strengthen the connection to the tongue portion. This arrangement allows the tongue portion to be firmly connected to the front of an article. With this arrangement, the tongue portion may remain disposed adjacent to a fastening system to protect a foot from unwanted friction.

Generally, a plurality of strips may be woven through continuous portions in any manner known in the art. In some embodiments, strips may be woven through one or more continuous portions in a weaving pattern including, but not limited to: plain weave, basket weave, twill pattern, herringbone pattern as well as other weaving patterns. In other embodiments, strips may be woven through a single aperture.

In an exemplary embodiment, at least one strip of first continuous portion 301 may be woven through apertures disposed in third continuous portion 303 to facilitate the attachment of third continuous portion 303 to article 102. In one embodiment, second strip set 322 of first continuous portion 301 may be woven through second set of apertures 362 of third continuous portion 303. In one embodiment, strips of second strip set 322 may be woven in an alternating manner in a plain weaving pattern through second set of apertures 362.

For purposes of clarity, the following discussion describes a weaving of two strips of second strip set 322 through second set of apertures 362. However, it should be understood that the remaining strips of second strip set 322 may be woven through second set of apertures 362 in a substantially similar manner.

In one embodiment, second strip set 322 includes second strip 402 disposed on medial portion 106 of base portion 116. In particular, first end portion 431 of second strip 402 may be integrally formed with medial portion 106 of base portion 116. In order to weave second strip 402 through second set of apertures 362, second end portion 432 of second strip 402 may be inserted underneath third continuous portion 303 to emerge through sixth aperture 376. After emerging from sixth aperture 376, second end portion 432 may be inserted into fifth aperture 375 and emerge through fourth aperture 374. Following the emergence through fourth aperture 374, second end portion 432 may be inserted into third aperture 373 and emerge out of second aperture 372. With second end portion 432 emerged from second aperture 372, second end portion 432 may be inserted into first aperture 371 and emerge from underneath third continuous portion 303. This allows second end portion 432 to be attached to lateral portion 107 of base portion 116 in any manner known in the art, including, but not limited to: stitching, adhesives and other methods. With this arrangement, second strip 402 may be woven through second set of apertures 362.

In a similar manner, third strip 403 of second strip set 322, disposed on lateral portion 107 of base portion 116, may be woven through second set of apertures 362. Specifically, second end portion 434 of third strip 403 may be woven through second set of apertures 362 while first end portion of third strip 403, not visible in this Figure, is integrally formed with lateral portion 107 of base portion 116. However, in this embodiment, third strip 403 may be woven through a subset of second set of apertures 362 due to the configuration of second set of apertures 362. In particular, third strip 403 may be woven through second aperture 372, third aperture 373, fourth aperture 374 and fifth aperture 375.

This weaving of third strip 403 can be accomplished by inserting second end portion 434 underneath third continuous portion 303 and through second aperture 372. After emerging through second aperture 372, second end portion 434 may be inserted through third aperture 373 and emerge from fourth aperture 374. Following the emergence of second end portion 434 from fourth aperture 374, second end portion 434 may be inserted through fifth aperture 375 and emerge from underneath third continuous portion 303. Following the emergence from underneath third continuous portion 303, second end portion 434 may be attached to medial portion 106 of base portion 116 in any manner known in the art. The remaining strips of second strip set 322 may be woven through second set of apertures 362 in a substantially similar manner.

By weaving second strip set 322 through second set of apertures 362, the connection between tongue portion 110 and a forward portion of article 102 may be reinforced. This reinforced connection allows tongue portion 110 to remain in place within article 102 to protect a foot from friction caused by a fastening system. Furthermore, this reinforced connection allows tongue portion 110 to work in conjunction with a fastening system to help fasten article 102 around a foot.

In some embodiments, the weaving of second strip set 322 through second set of apertures 362 may form toe portion 113 of article 102. In some cases, first surfaces 436 of second strip set 322 form an inner portion of toe portion 113. Likewise, second surfaces 437 of second strip set 322 form an outer portion of toe portion 113. With this configuration, toe portion 113 may be formed through the connection of second strip set 322 with second set of apertures 362 of third continuous portion 303.

As previously discussed, second continuous portion 302 may extend around an upper periphery of article 102, as illustrated in FIG. 1. In order to associate second continuous portion 302 with an upper periphery of article 102, second continuous portion 302 may be rounded so that intermediate portion 353 may be associated with heel portion 114 of article 102, as illustrated in FIG. 5. Similarly, first portion 351 may be associated with lateral portion 107 of article 102. Also, first portion 351 may be associated with lacing system 109. Finally, second portion 352 may be associated with medial portion 106 of article 102. Furthermore, second portion 352 may be associated with lacing system 109. With this arrangement, second continuous portion 302 may be disposed to form throat 103 of article 102.

An article configured with strips can include provisions to increase the strength of a connection between a first continuous portion and a second continuous portion. In some cases, this can be accomplished by weaving strips of a first continuous portion through apertures disposed on a second continuous portion. Referring to FIG. 5, first strip set 321 of first continuous portion 301 may be woven through first set of apertures 361 of second continuous portion 302 in order to strengthen a connection between first continuous portion 301 and second continuous portion 302.

In some embodiments, strips of first strip set 321 may be inserted within apertures of first set of apertures 361 and folded over a portion of third continuous portion 303. In other embodiments, strips of first strip set 321 may be woven with first set of apertures 361 in another manner. In one embodiment, strips of first strip set 321 may be inserted through apertures of first set of apertures 361 so that intermediate portions of strips occupy apertures and end portions of strips are connected to first continuous portion 301.

For purposes of clarity, the following discussion describes a weaving of one strip of first strip set 321 through first set of apertures 361. However, it should be understood that the remaining strips of first strip set 321 may be woven through first set of apertures 361 in a substantially similar manner. As previously discussed, in one embodiment, first strip set 321 includes first strip 310.

Referring to FIG. 5, first strip 310 extends from base portion 116 on medial portion 106 of article 102. In particular, first end portion 331 is integrally formed with base portion 116. In order to weave first strip 310 through first set of apertures 361, second end portion 332 of first strip 310 may be inserted into an aperture of first set of apertures 361. In one embodiment, second end portion 332 may be inserted through aperture 401 of first set of apertures 361. In some cases, second end portion 332 may be inserted through aperture 401 so that first surface 336 of first strip 310 is directed toward an interior portion of article 102. Similarly, second surface 337 of first strip 310 may be directed toward an outer portion of article 102. After inserting second end portion 332 through aperture 401, second end portion 332 may be pulled downward toward base portion 116. With this weaving of first strip 310, intermediate portion 335 may be disposed through aperture 401. This arrangement exposes a portion of first surface 336 and a portion of second surface 337 on an outer portion of article 102.

In some cases, second end portion 332 may be attached to first continuous portion 301 to secure the weaving of first strip 310 through aperture 401. Generally, second end portion 332 may be attached to any portion of first continuous portion 301 using any method known in the art, such as with an adhesive, stitching, welding, or any other type of attachment. Referring to FIG. 2, second end portion 332 may be attached to base portion 116 of first continuous portion 301. In some cases, second end portion 332 may be attached to outer periphery 312 of base portion 116. In other cases, second end portion 332 may be attached to central portion 313 of base portion 116. In still other cases, second end portion 332 may be attached directly to first end portion 331 of first strip 310. By varying the point of attachment of second end portion 332 to first continuous portion 301, the appearance of article 102 may be altered. For example, by offsetting the attachment of second end portion 332 from first end portion 331, first end portion 331 may be visible on an outer portion of article 102, as illustrated in FIG. 5.

By weaving the remaining strips of first strip set 321 through first set of apertures 361, the connection between first continuous portion 301 and second continuous portion 302 may be reinforced. Furthermore, the sides and heel of article 102 may be formed. Specifically, medial portion 106 and lateral portion 107 of middle portion 115, as well as heel portion 114 of article 102, may be formed by weaving first strip set 321 through first set of apertures 361.

In addition, as the weaving of first strip set 321 through first set of apertures 361 strengthens the connection between first continuous portion 301 and second continuous portion 302, intermediate portion 353 of second continuous portion 302 may be secured in place to form throat 103. With this arrangement, first portion 351 and second portion 352 may be disposed on middle portion 115 to form lacing system 109.

In embodiments where an article includes a lacing system, an article may include provisions to strengthen the connection between continuous portions of the article by inserting the lace through one or more continuous portions of the article. In some embodiments, the lace may be inserted through more than two continuous portions of an article. In an exemplary embodiment, the lace may be inserted through two continuous portions of an article.

Referring to FIG. 6, lace 108 may be inserted through third continuous portion 303 in order to secure lace 108 to article 102. In one embodiment, lace 108 may be inserted through third aperture 373 and fourth aperture 374. In addition, lace 108 may be laced through lacing holes 341 disposed on first portion 351 and second portion 352 of second continuous portion 302. With this arrangement, lace 108 may strengthen the connection between third continuous portion 303 and second continuous portion 302.

Generally, lace 108 may be laced through lacing holes 341 in any manner known in the art. After securing lace 108 through lacing holes 341 and third continuous portion 303, lace 108 may be pulled to tighten article 102 around a foot. With this arrangement, lace 108 may secure article 102 to a foot inserted within article 102.

Figure 7:
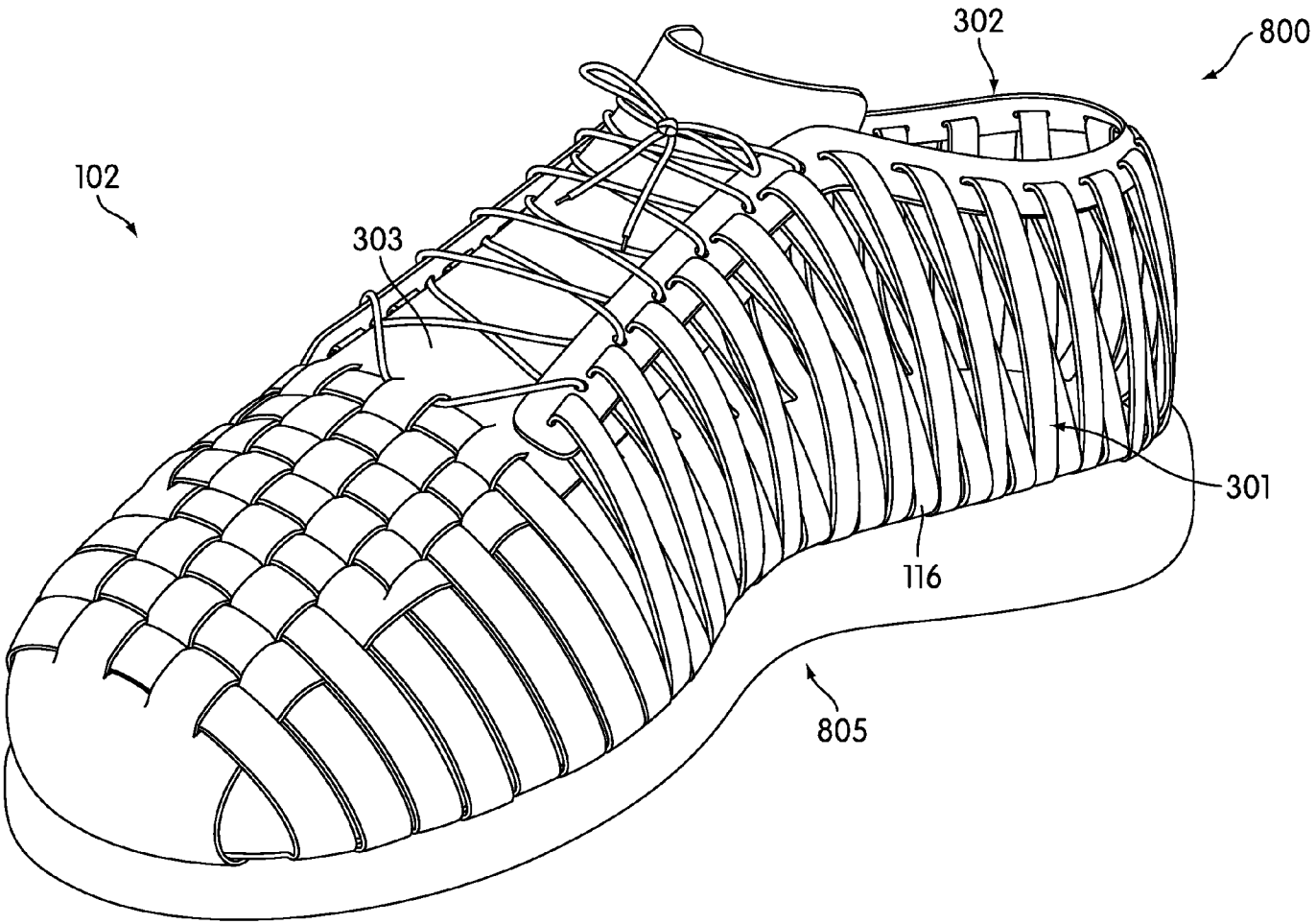
FIG. 7 is an isometric view of an exemplary embodiment of an article of footwear including a sole system.

As previously discussed, an article comprising a few continuous portions may be associated with a sole system. This can allow the article comprising a few continuous portions to be configured as an upper for an article of footwear. Referring to FIG. 7, article 102 may be configured as an upper and associated with sole system 805. Generally, sole system 805 may comprise any type of sole configured for an article of footwear. In some embodiments, sole system 805 includes an insole, midsole and/or outsole. In one embodiment, sole system 805 includes a midsole and an outsole.

In different embodiments, different continuous portions of article 102 may be attached to sole system 805 to assemble article of footwear 800. For example, in some embodiments, first continuous portion 301 and third continuous portion 303 may be attached to sole system 805 to assemble article of footwear 800. In other embodiments, only first continuous portion 301 may be attached to sole system 805 to assemble article of footwear 800. In one embodiment, base portion 116 of first continuous portion 301 may be attached to sole system 805 through any method known in the art, including, but not limited to: adhesives, stitching and other methods of attachment. Furthermore, base portion 116 may be configured as an insole for sole system 805. With this arrangement, article 102 and sole system 805 may form article of footwear 800.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a first continuous portion including a base portion and a plurality of strips;

the plurality of strips comprising a first set of strips and a second set of strips;

a second continuous portion extending around an upper periphery of the article, the second continuous portion including a first set of apertures;

a third continuous portion including a second set of apertures;

wherein at least one strip of the first set of strips comprises a first end portion, a second end portion and an intermediate portion disposed between the first end portion and the second end portion;

wherein the first end portion is continuous with an outer periphery of the base portion along a first side of the article of footwear associated with one of a medial portion and a lateral portion and wherein the second end portion is attached to the base portion along the first side;

wherein the intermediate portion of the at least one strip is disposed through at least one aperture of the first set of apertures in the second continuous portion; and wherein at least one strip of the second set of strips is disposed through at least one aperture of the second set of apertures in the third continuous portion.

2. The article of footwear according to claim 1, wherein the at least one strip of the second set of strips comprises a first end portion continuous with the outer periphery of the base portion along the first side of the article of footwear and a second end portion attached to the base portion along a second side of the article of footwear disposed opposite of the first side.

3. The article of footwear according to claim 1, wherein the third continuous portion includes a first end portion and a second end portion, the first end portion being associated with a toe portion of the article of footwear and the second end portion being disposed adjacent to a throat opening of the article of footwear.

4. The article of footwear according to claim 3, wherein the second set of apertures are disposed on at least one of the first end portion and the second end portion of the third continuous portion.

5. The article of footwear according to claim 3, wherein the first end portion of the third continuous portion further comprises an extended portion configured to attach to the base portion of the first continuous portion.

6. The article of footwear according to claim 1, further comprising a sole system; and wherein at least the first continuous portion is attached to the sole system.

7. An article of footwear, comprising:

a first continuous portion including a base portion and a plurality of strips;

the plurality of strips comprising a first set of strips and a second set of strips;

a second continuous portion extending around an upper periphery of the article, the second continuous portion including a first set of apertures;

a third continuous portion including a second set of apertures;

wherein at least one strip of the second set of strips comprises a first end portion and a second end portion;

wherein the first end portion is continuous with an outer periphery of the base portion along a first side of the article of footwear associated with one of a medial portion and a lateral portion and wherein the second end portion is attached to the base portion along a second side of the article of footwear disposed opposite of the first side;

wherein the at least one strip of the second set of strips is disposed through at least one aperture of the second set of apertures in the third continuous portion;

wherein at least one strip of the first set of strips is disposed through at least one aperture of the first set of apertures in the second continuous portion;

wherein the at least one strip of the first set of strips comprises a first end portion, a second end portion and an intermediate portion disposed between said first end portion and said second end portion of the at least one strip of the first set of strips;

wherein the first end portion of the at least one strip of the first set of strips is continuous with the outer periphery of the base portion along the first side of the article of footwear and wherein the second end portion of the at least one strip of the first set of strips is attached to the base portion along the first side; and wherein the first end portion of the at least one strip of the first set of strips is disposed adjacent to the second end portion of the at least one strip in a direction running along a length of the article of footwear on the first side.

8. The article of footwear according to claim 7, further comprising a sole system.

9. The article of footwear according to claim 8, wherein at least the first continuous portion is attached to the sole system.

10. The article of footwear according to claim 7, wherein the second end portion of the at least one strip of the first set of strips is attached to a central portion of the base portion.

11. The article of footwear according to claim 7, wherein the second end portion of the at least one strip of the first set of strips is attached to the first end portion of the at least one strip of the first set of strips.

12. The article of footwear according to claim 7, wherein the second continuous portion further includes a plurality of lacing holes for receiving a lace.

13. The article of footwear according to claim 12, wherein the at least one aperture of the second set of apertures in the third continuous portion is further configured to receive a portion of a lace.

14. An article of footwear, comprising:

a first continuous portion including a base portion and a plurality of strips;

a second continuous portion extending around an upper periphery of the article, the second continuous portion including a plurality of apertures;

a first at least one strip of the plurality of strips comprising a first end portion, a second end portion and an intermediate portion disposed between the first end portion and the second end portion;

the first at least one strip further comprising a first surface and a second surface disposed opposite of the first surface;

wherein the first end portion is continuous with an outer periphery of the base portion and wherein the second end portion is attached to the base portion;

wherein the intermediate portion of the first at least one strip is disposed through at least one aperture of the plurality of apertures in the second continuous portion;

wherein a portion of the first surface and a portion of the second surface are exposed on an outer portion of the article of footwear along the same side of the article of footwear;

the article of footwear further comprising a third continuous portion including a plurality of apertures; and wherein a second at least one strip of the plurality of strips is configured to be disposed through at least one aperture of the plurality of apertures in the third continuous portion.

15. The article of footwear according to claim 14, wherein the second continuous portion includes a first portion associated with a lateral portion of the article of footwear and a second portion associated with a medial portion of the article of footwear.

16. The article of footwear according to claim 15, wherein the at least one aperture is disposed on said second portion of the second continuous portion; and wherein the first end portion and the second end portion of the first at least one strip are associated with the medial portion of the article of footwear.

17. The article of footwear according to claim 15, wherein the at least one aperture is disposed on said first portion of the second continuous portion; and wherein the first end portion and the second end portion of the first at least one strip are associated with the lateral portion of the article of footwear.

18. The article of footwear according to claim 14, wherein the second continuous portion further includes a plurality of lacing holes for receiving a lace.

19. The article of footwear according to claim 14, wherein the second at least one strip configured to be disposed through the at least one aperture in the third continuous portion includes a first end portion and a second end portion;

wherein said first end portion of the second at least one strip is continuous with the outer periphery of the base portion on a first side of the article of footwear and wherein said second end portion of the second at least one strip is attached to the base portion on a side of the article of footwear opposite to the first side.

20. The article of footwear according to claim 14, further comprising a sole system; and wherein at least the first continuous portion is attached to the sole system.

* * * * *